US011785383B2

(12) United States Patent
Fan et al.

(10) Patent No.: US 11,785,383 B2
(45) Date of Patent: Oct. 10, 2023

(54) METHOD AND SYSTEM FOR COMPENSATING FREQUENCY RESPONSE OF MICROPHONE

(71) Applicant: HARMAN INTERNATIONAL INDUSTRIES, INCORPORATED, Stamford, CT (US)

(72) Inventors: Xueli Fan, Shanghai (CN); Xiangru Bi, Shanghai (CN)

(73) Assignee: Harman International Industries, Incorporated, Stamford, CT (US)

( * ) Notice: Subject to any disclaimer, the term of this patent is extended or adjusted under 35 U.S.C. 154(b) by 271 days.

(21) Appl. No.: 17/365,402

(22) Filed: Jul. 1, 2021

(65) Prior Publication Data

US 2022/0007110 A1 Jan. 6, 2022
US 2022/0345818 A9 Oct. 27, 2022

(30) Foreign Application Priority Data

Jul. 3, 2020 (CN) ..... 202010636777.2

(51) Int. Cl.
*H04R 3/00* (2006.01)
*H04R 29/00* (2006.01)
*H04R 3/06* (2006.01)

(52) U.S. Cl.
CPC ..... *H04R 3/06* (2013.01); *H04R 3/005* (2013.01); *H04R 29/005* (2013.01)

(58) Field of Classification Search
CPC ..... H04R 3/06; H04R 3/005; H04R 29/005
USPC ..... 381/92
See application file for complete search history.

(56) References Cited

U.S. PATENT DOCUMENTS 8,855,330 B2 10/2014 Taenzer
9,363,598 B1 * 6/2016 Yang ..... H04R 3/005
2004/0165735 A1 8/2004 Opitz

FOREIGN PATENT DOCUMENTS

EP 1478208 A1 11/2004

OTHER PUBLICATIONS

Extended European Search Report dated Dec. 8, 2021 for European Application No. 21181931.3 filed Jun. 28, 2021, 9 pages.

* cited by examiner

*Primary Examiner* — Paul Kim
(74) *Attorney, Agent, or Firm* — Brooks Kushman P.C.

(57) ABSTRACT

A method and system for compensating a frequency response of a microphone array are provided. The method includes: multiple microphones in a microphone array respectively receiving a compensation signal sent from a calibration speaker and outputting multiple output signals respectively; determining a uniform frequency response of the multiple microphones based on the multiple output signals; calculating a compensation gain for each of the multiple microphones according to the uniform frequency response; and storing the calculated compensation gain of each microphone.

14 Claims, 5 Drawing Sheets

METHOD AND SYSTEM FOR COMPENSATING FREQUENCY RESPONSE OF MICROPHONE

CROSS-REFERENCE TO RELATED APPLICATIONS

This application claims priority to Chinese Application No. 202010636777.2 filed Jul. 3, 2020, the disclosure of which is hereby incorporated in its entirety by reference herein.

TECHNICAL FIELD

The present invention relates to the field of voice enhancement and voice separation, and more particularly, to a method and system for compensating a frequency response of a microphone in a vehicle.

BACKGROUND

With the continuous intelligentization of vehicles, more and more attention has been paid to the field of on-board voice enhancement and multi-voice separation. Generally, multiple on-board microphones have been calibrated to be completely consistent before delivery to ensure the accuracy of execution results of various voice-related algorithms (e.g., a blind source separation algorithm). However, losses of the microphones will be different in use due to various reasons such as use time, temperature, and humidity, and thus characteristics of the microphones will become different. This will bring many disadvantages. For example, when there is more than one passenger talking at the same time in a vehicle, a host system of the vehicle often cannot perform voice separation well. This is because predetermined conditions required by a voice separation algorithm cannot be satisfied any longer due to the inconsistent degradation of microphone performance. This will provide a bad user experience for users. In addition, if a worn microphone needs to be replaced or recalibrated, users need to return the vehicle to the factory for repair. Such repairs are inconvenient users.

Therefore, it is necessary to develop a method and system capable of compensating a frequency response of an on-board microphone to improve the accuracy of voice processing algorithms (e.g., blind source separation), so as to bring better user experience to users.

SUMMARY

One or more embodiments of the present invention provide a method for compensating a frequency response of a microphone. The method includes receiving a compensation signal at multiple microphones in a microphone array from a calibration speaker and outputting multiple output signals. A uniform frequency response of the multiple microphones is determined based on the multiple output signals. A compensation gain is calculated for each microphone in the microphone array according to the uniform frequency response, and the calculated compensation gain of each microphone is stored.

One or more embodiments of the present invention provide a system for compensating a frequency response of a microphone. The system includes a calibration speaker, a microphone array, a processor, and a memory. The calibration speaker is configured to send out a compensation signal to the microphone array. Multiple microphones in the microphone array receive the compensation signal sent from the calibration speaker and output multiple microphone output signals. The processor is configured to: determine a uniform frequency response of the multiple microphones based on the multiple output signals, and calculate a compensation gain for each of the multiple microphones according to the uniform frequency response. The memory is configured to store the calculated compensation gain for each microphone.

One or more embodiments of the present invention provide a computer-readable medium configured to perform steps of the method described above.

Advantageously, the method and system for compensating a frequency response disclosed in the present invention can conveniently and flexibly improve the accuracy of blind source separation, thereby bringing better user experience to users.

BRIEF DESCRIPTION OF THE DRAWINGS

The system may be better understood with reference to the following description and in conjunction with the accompanying drawings. Parts in the figures are not to scale, but the focus is placed on explaining the principle of the present invention. In addition, in the figures, similar or identical reference numerals refer to similar or identical elements.

DETAILED DESCRIPTION

Figure 1:
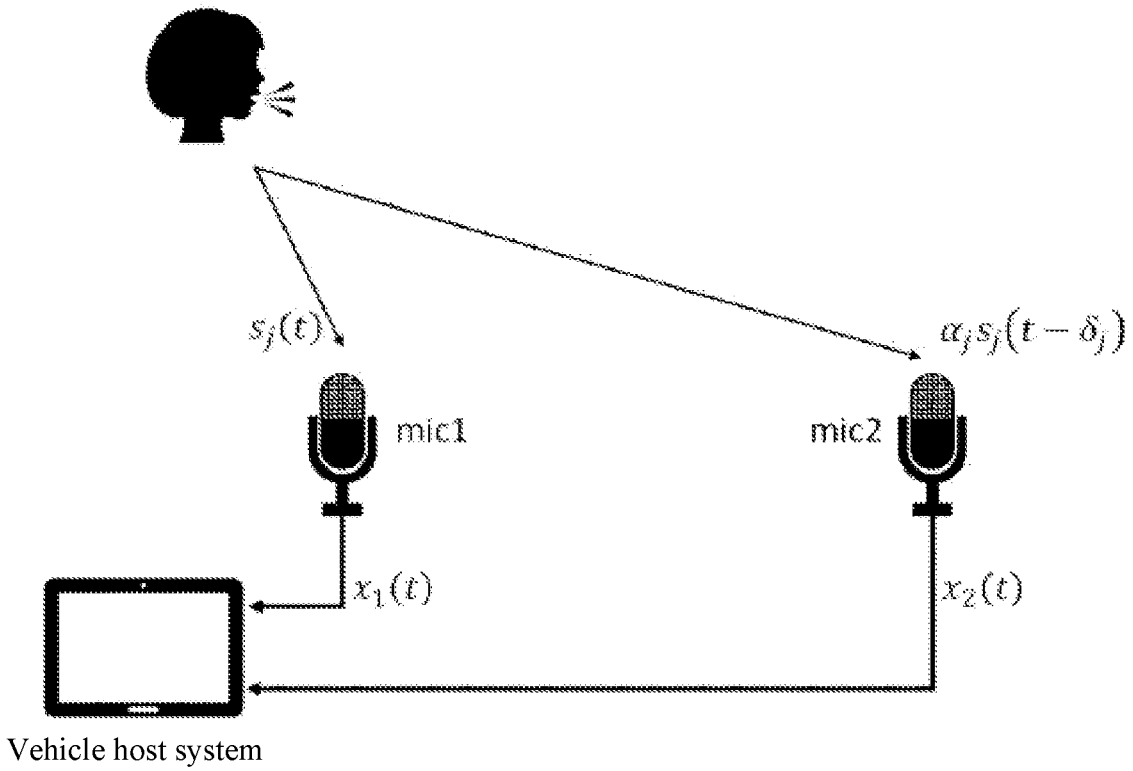
FIG. 1 is a schematic diagram that illustrates a sound source and a microphone in a vehicle environment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It should be understood that the following description of the embodiments is given for illustrative purposes only, and not restrictive. The division of examples in the functional blocks, modules, or units shown in the drawings should not be construed as representing these functional blocks, and these modules or units must be implemented as physically separated units. The functional blocks, modules, or units shown or described may be implemented as individual units, circuits, chips, functions, modules, or circuit elements. One or more functional blocks or units may also be implemented in a common circuit, chip, circuit element, or unit.

When multiple people are talking in a vehicle at the same time, some voice enhancement processing, such as a blind spot separation (BSS) algorithm, is required to isolate clean voices in the voice recognition process. FIG. 1 is a schematic diagram for illustratively illustrating a sound source and a microphone in a vehicle environment. For ease of understanding, there are, for example, only two microphones in the figure and only one sound source is shown to illustrate a simple principle of, for example, BSS. As shown in FIG. 1, in a method such as DUET, signals received at a pair of microphones are expressed as N source signals $s_j(t)$,j=1, 2, . . . , N, and output signals of the two microphones are expressed as $x_1(t)$ and $x_2(t)$, which may be respectively expressed as:

$$x_1(t)=\Sigma_{j=1}^{N}s_j(t)$$

$$x_2(t)=\Sigma_{j=1}^{N}\alpha_j s_j(t-\delta_j)$$

where N represents the number of sources, $\delta_j$ represents an arrival delay between the microphones (i.e., a time difference between sound from a source to two microphones), and $\alpha_j$ is a relative attenuation factor, which corresponds to an attenuation ratio of a path between the source and the microphones.

The above expression assumes that the microphones have the same frequency response. In other words, when a person speaks to microphones (j=1), if the distances between the person and the microphones are the same ($\alpha$=1, $\delta$=0), the microphone inputs are the same (s(t)), so the microphone outputs should be the same, i.e. $x_1$ (t)=$x_2$ (t). However, in use, attributes of the microphones will change with time, temperature, and humidity, and the changes may be inconsistent. Even microphones with the same initial specifications may have inconsistent attributes after being used for a period of time. That is, even though the inputs are both s(t), output signals $x_1$(t) and $x_2$ (t) are not the same.

Figure 2:
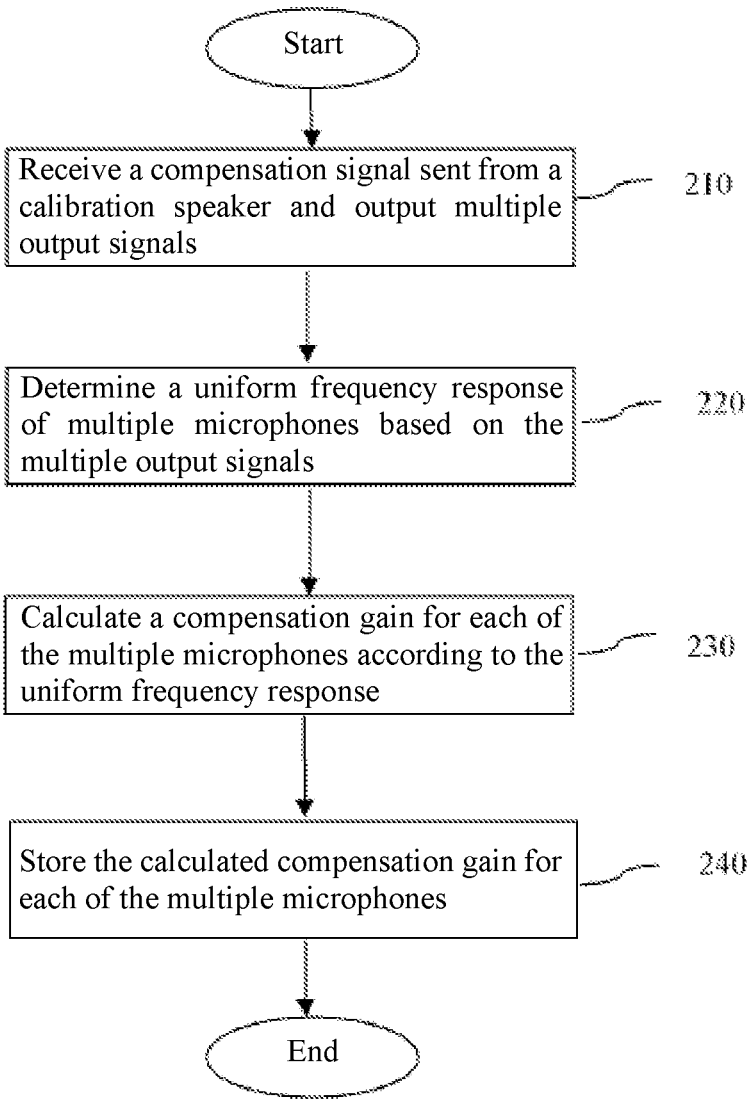
FIG. 2 is a flow chart of a method for compensating frequency responses of multiple microphones in a microphone array according to one or more embodiments of the present invention.

FIG. 2 shows a flow chart of a method for compensating frequency responses of multiple microphones in a microphone array to realize recalibration of the microphones according to one or more embodiments. A user or operator can initiate the process of recalibrating multiple microphones in a microphone array according to a voice recognition situation inside a vehicle. For example, a user can initiate the compensation method shown in FIG. 2 by triggering a microphone calibration start switch of the vehicle or a touch screen to send a microphone recalibration control signal to a vehicle host system. For example, at S210, after receiving the recalibration control signal, a calibration speaker in the vehicle may send out a compensation signal (i.e., a reference signal). The calibration speaker may be a speaker of a mobile device, a speaker in a vehicle audio system, or any other type of omnidirectional speaker. At S210, multiple microphones in a microphone array receive a compensation signal sent from a calibration speaker and output multiple microphone output signals respectively. At S220, for example, the multiple microphone output signals may be received through the vehicle host system/processor, and a uniform frequency response of the multiple microphones may be determined based on the multiple output signals. At S230, a compensation gain is calculated for each of the multiple microphones according to the uniform frequency response. At S240, the compensation gain calculated for each microphone may be stored for use when a voice processing algorithm (e.g., a BBS algorithm) is invoked.

Figure 3:
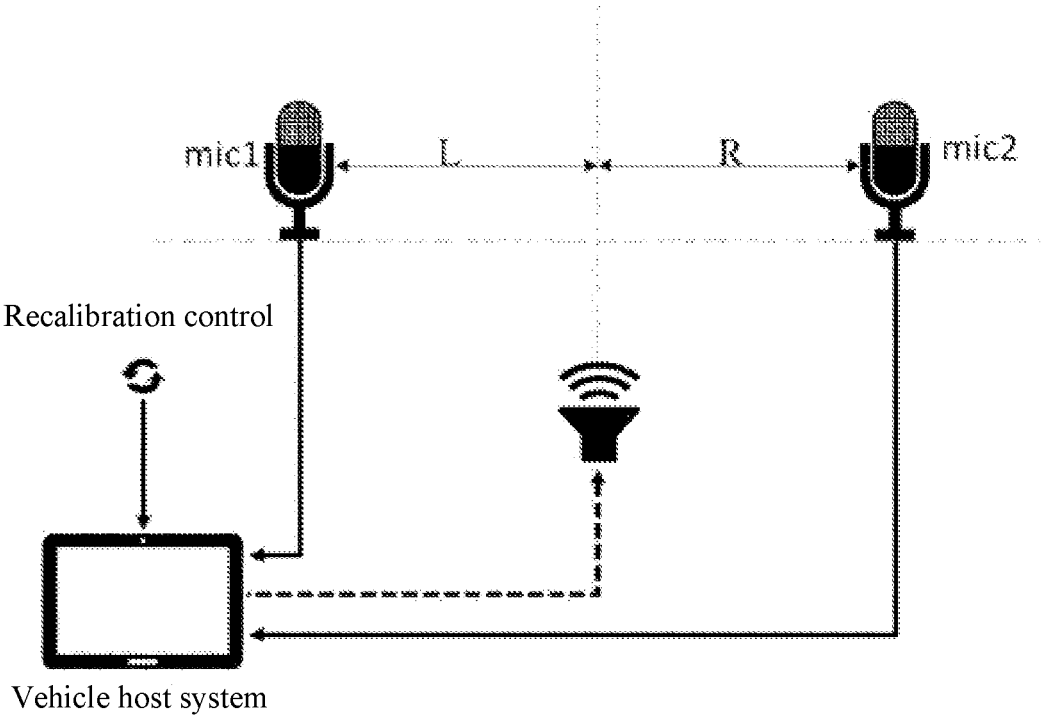
FIG. 3 is a schematic diagram of recalibrating microphones in a microphone array to keep outputs of the microphones in the microphone array consistent according to one or more embodiments of the present invention.

FIG. 3 illustratively shows a schematic diagram of recalibrating microphones in a microphone array to keep outputs of the microphones in the microphone array consistent. In FIG. 3, for ease of description, a microphone array including only two microphones is taken as an example. For example, microphone 1 (mic1) and microphone 2 (mic2) may be microphones fixed in a vehicle, and may be coupled to a vehicle host system (e.g., a processor or a controller). A speaker is arranged on a central symmetry axis of the microphone array. As shown in the figure, distance L is equal to distance R, so the speaker is equally spaced from microphone 1 and microphone 2.

After receiving a recalibration control signal sent by a user to the system, the system is set in a recalibration mode. The control signal controls the speaker to send out a compensation signal, and microphone 1 and microphone 2 are started to record the compensation signal and respectively output microphone output signals $x_1$(t) and $x_2$(t) to the vehicle host system. The compensation signal may be a chrip signal with a broadband frequency and a uniform amplitude. For example, the chrip signal may linearly scan from a frequency of 0.1 kHz to a frequency of 4 kHz, and the duration is always 5 s. For example, the recording duration of the microphone is about 7-8 s. However, those skilled in the art can understand that the chrip range of the chrip signal, the duration, the microphone recording time, and other parameters are described here as examples only, and are not intended to be specifically limited. The above parameters may be changed according to specific requirements.

The vehicle host system receives the microphone output signals $x_1$(t) and $x_2$(t), and converts the output signals into frequency domain signals X1($j\omega$) and X2($j\omega$). Then, a uniform frequency response (UFR) of microphone 1 and microphone 2 may be calculated based on the frequency domain signals. Next, gains of the two microphones may be calculated based on the uniform frequency response. For example, a compensation gain of microphone 1 is gain1 and a compensation gain of microphone 2 is gain2. Finally, the calculated compensation gains gain1 and gain2 of the two microphones may be saved in the system for use in algorithms such as BSS. For example, once the BSS algorithm is invoked, calibrated and updated; microphone gains are first invoked from a memory to compensate frequency responses of the microphone output signals, and then the compensated output signals are used as inputs to the BSS algorithm. For example, a frequency spectrum of an audio signal received from microphone 1 will be multiplied by gain1, and a frequency spectrum of an audio signal received from microphone 2 will be multiplied by gain2. Therefore, the frequency responses of the output signals of the two microphones are compensated through the stored corresponding compensation gains. The accuracy of subsequent voice processing algorithms (such as the BSS algorithm) is further improved.

Figure 4:
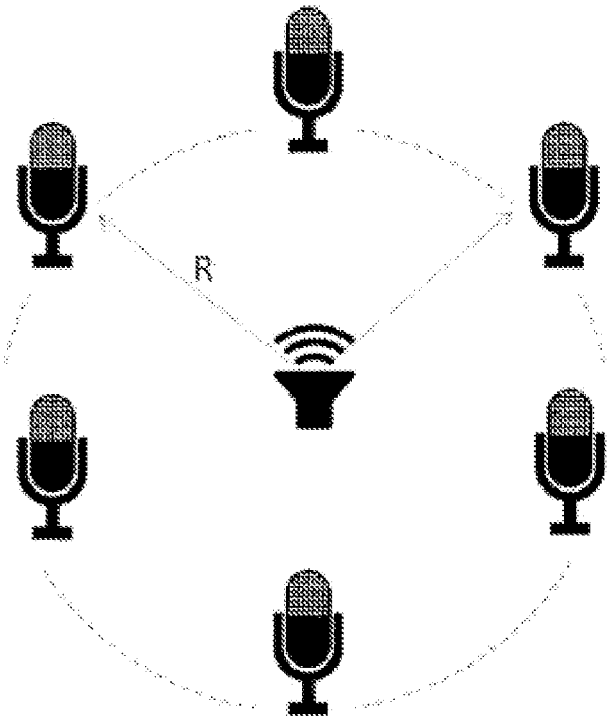
FIG. 4 is a schematic diagram of a microphone array arranged in the form of a circular array or a spherical array according to one or more embodiments of the present invention.
Figure 5:
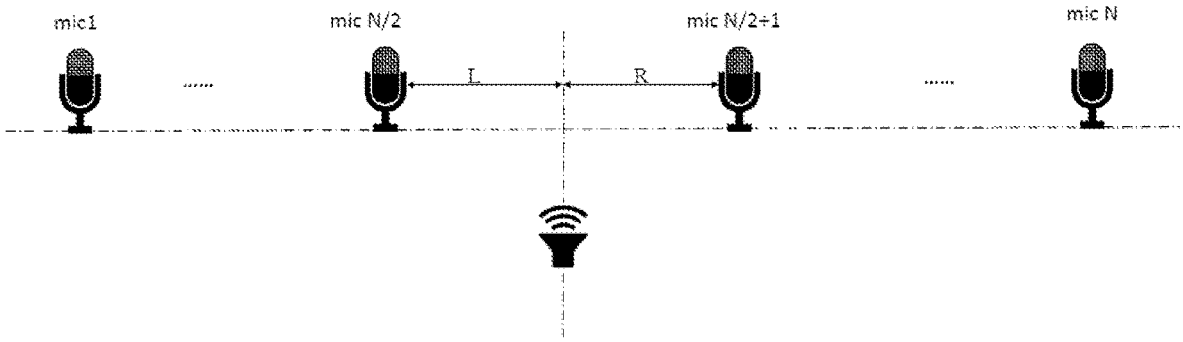
FIG. 5 is a schematic diagram of a microphone array arranged in the form of a linear array according to one or more embodiments of the present invention.
Figure 6:
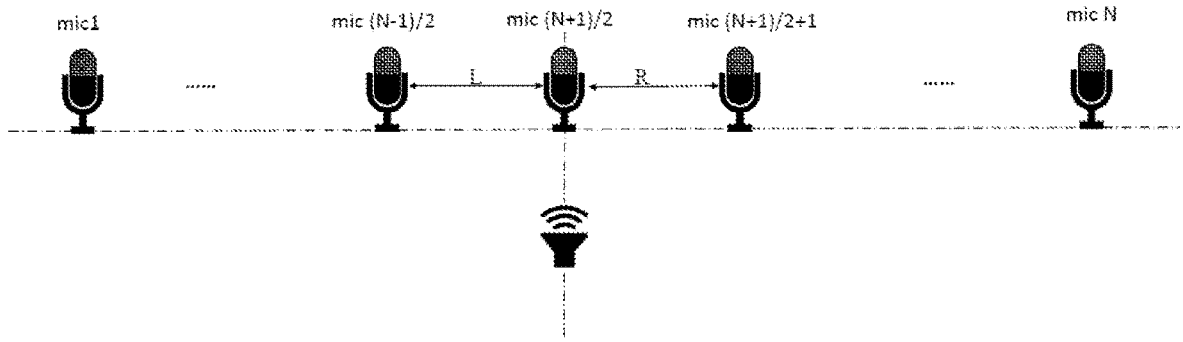
FIG. 6 is a schematic diagram of another microphone array arranged in the form of a linear array according to one or more embodiments of the present invention.

For the purpose of briefly explaining the principle, FIG. 3 only shows an example in which a microphone array includes two microphones. However, the microphone array may include more microphones and may have different array arrangements according to actual needs. For example, the microphone array may be a circular array, a spherical array, or a linear array, as shown in FIGS. 4 to 6. The following will explain how to compensate frequency responses of multiple microphones in different types of microphone arrays with reference to different microphone arrays illustrated in FIGS. 3 to 6.

FIG. 4 shows a schematic diagram of a microphone array being a circular array or a spherical array. Speakers in FIGS. 3 and 4 are both arranged on a central symmetry axis of the microphone array and equally spaced from the microphones.

For the microphone array in FIGS. 3 and 4, for example, a frequency response of an output signal of any microphone in the microphone array may be selected as a UFR, a compensation gain of the selected microphone is set to 1, and a compensation gain of each microphone in the remaining microphones is calculated as a ratio of the UFR to a frequency response amplitude of an output signal of the microphone. For example, the gain of the selected microphone may be set to gain=1, and the gains of the remaining microphones may be calculated as:

$$\text{gain}\,2 = \frac{UFR(j\omega)}{|X_2(j\omega)|}, \ldots \text{ gain } N = \frac{UFR(j\omega)}{|X_N(j\omega)|}.$$

Alternatively, frequency response amplitudes of output signals of all or part of the microphones in the microphone array may be calculated respectively, and a weighted sum of the frequency response amplitudes may be calculated, thereby calculating the UFR of all or part of the microphones. For example, $$UFR=a*|X_1(j\omega)|+b*|X_2(j\omega)|+\ldots+q*|X_p(j\omega)|,$$

where p≤N, a+b+ . . . +q=1, N represent the total number of microphones in the microphone array, P represents the number of partial microphones in the microphone array, and a, b . . . p are weight coefficients of corresponding microphones respectively. For example, the weight coefficients may be equal to 1/p, or may also be set according to the importances of the microphones. For example, if the output of a certain microphone is more important, the weighting coefficient thereof is larger.

Then, a ratio of the UFR to a frequency response amplitude of an output signal of each microphone may be calculated, thereby calculating the compensation gain of each microphone in the microphone array. For example, $$\text{gain } 1 = \frac{UFR(j\omega)}{|X_1(j\omega)|},$$

$$\text{gain } 2 = \frac{UFR(j\omega)}{|X_2(j\omega)|} \ldots \text{ gain } N = \frac{UFR(j\omega)}{|X_N(j\omega)|}$$

Alternatively, frequency response energy values of the output signals of all or part of the microphones in the microphone array may be calculated respectively, and a UFR of all or part of microphones in the microphone array is obtained by calculating a weighted sum of the frequency response energy values. For example, $$UFR=a*|X_1(j\omega)|^2+b*|X_2(j\omega)|^2+\ldots+q*|X_p(j\omega)|^2)^{1/2},$$

where p≤N, a+b+ . . . +q=1, N represent the total number of microphones in the microphone array, P represents the number of partial microphones in the microphone array, and a, b . . . p are weight coefficients of corresponding microphones respectively.

Then, the compensation gain of each microphone may be calculated by calculating a ratio of the UFR to a frequency response energy of an output signal of the microphone. For example, $$\text{gain } 1 = \frac{UFR(j\omega)}{|X_1(j\omega)|^2},$$

$$\text{gain } 2 = \frac{UFR(j\omega)}{|X_2(j\omega)|^2} \ldots \text{ gain } N = \frac{UFR(j\omega)}{|X_N(j\omega)|^2}$$

FIGS. 5 and 6 show schematic diagrams of a microphone array arranged in the form of a linear array. In the linear array illustrated in FIGS. 5 and 6, the calibration speaker is arranged on the central symmetry axis of the microphone array. In this configuration, there is no situation where the speaker is equally spaced from the microphones.

The microphone array arranged in a linear array shown in FIG. 5 includes an even number of microphones. In the arrangement of an even number of microphones shown in FIG. 5, for example, the number of microphones is N, and the speaker is placed on the central symmetry axis of the N/2th microphone and the (N/2+1)th microphone. In order to calculate the compensation gain of each microphone, the microphones may be grouped first. For example, every two microphones equally spaced from the speaker may be grouped, and a total of N/2 microphone groups may be obtained. For example, the first group of microphones includes two microphones numbered 1 and N, the second group of microphones includes microphones numbered 2 and N−1, . . . , the N/2th group of microphones includes microphones numbered N/2 and N/2+1.

For each group of microphones, the gain may be calculated according to a dual-microphone frequency response compensation scheme shown in FIG. 3. For example, a frequency response of an output signal of a microphone numbered 1 in the first group of microphones is selected as the UFR, a compensation gain of the selected microphone numbered 1 is set to 1, and a compensation gain of the other microphone numbered N is obtained by calculating a ratio of the UFR to a frequency response amplitude of an output signal of the other microphone in the group of microphones. Therefore, the gain of the microphone numbered 1 in this group may be set to gainN=1, and the gain of the other microphone numbered N in this group may be calculated as $$\text{gain } N = \frac{UFR(j\omega)}{|X_N(j\omega)|}.$$

By analogy, the gains of the microphones numbered N/2 and N/2+1 in the N/2th group of microphones are calculated, so that compensation gains of all the microphones are finally obtained.

Alternatively, frequency response amplitudes of output signals of two microphones in each group of microphones may be calculated, and a weighted sum of the frequency response amplitudes may be taken as a UFR of the group. By calculating a ratio of the UFR of each group to the frequency response amplitude of the output signal of each microphone in the group, a compensation gain of each microphone in the group of microphones is obtained.

For example, the UFR of the first group of microphones may be calculated by the following formula:

$$UFR=a*|X_1(j\omega)|+q*|X_N(j\omega)|,$$

Then, the gains of two microphones in the first group of microphones are respectively calculated as:

$$\text{gain } 1 = \frac{UFR(j\omega)}{|X_1(j\omega)|},$$

$$\text{gain } N = \frac{UFR(j\omega)}{|X_N(j\omega)|}$$

By analogy, the gains of the microphones numbered N/2 and N/2+1 in the N/2th group of microphones are calculated, so that the gains of all the microphones are calculated.

Alternatively, frequency response energies of output signals of two microphones in each group of microphones may be calculated, and a weighted sum of the frequency response energies may be taken as a UFR of the group. Then, the compensation gain of each microphone in each group is calculated by calculating a ratio of the UFR of the group to a frequency response energy of an output signal of the microphone.

For example, the UFR of the first group of microphones may be calculated by the following formula:

$$UFR=a*|X_1(j\omega)|+q*|X_p(j\omega)|^2)^{1/2},$$

The gains of two microphones in the first group of microphones are respectively calculated as:

$$\text{gain } 1 = \frac{UFR(j\omega)}{|X_1(j\omega)|^2},$$

$$\text{gain } N = \frac{UFR(j\omega)}{|X_N(j\omega)|^2}$$

By analogy, the gains of the microphones numbered N/2 and N/2+1 in the N/2th group of microphones are calculated, so that the gains of all the microphones are calculated.

The microphone array arranged in a linear array shown in FIG. 6 includes an odd number of microphones. For example, if the number of microphones is N (N is an odd number), the speaker is placed on the axis of the (N+1)/2th microphone. Other than the (N+1)/2th microphone, every two microphones with the same distance are grouped, and a total of (N−1)/2 microphone groups are obtained. For example, the first group of microphones includes two microphones numbered 1 and N, the second group of microphones includes microphones numbered 2 and N−1, . . . , the (N−1)/2th group of microphones includes microphones numbered (N−1)/2 and (N+1)/2+1. In this case, the gain of the (N+1)/2th microphone is individually set to gain((N+1)/2)=1. For other groups of microphones, the same method described with reference to FIG. 5 may be used to calculate the gain of each microphone, so as to finally obtain the gains of all the microphones: gain1, . . . , gain (N−1)/2, gain ((N+1)/2+1), . . . , gain N.

Figure 7:
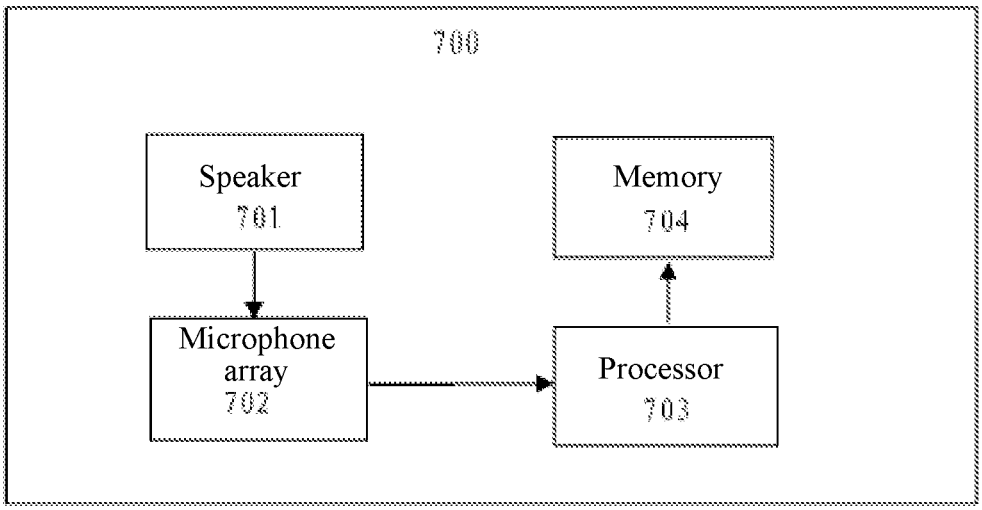
FIG. 7 is a block diagram of a system for compensating frequency responses of multiple microphones in a microphone array according to one or more embodiments of the present invention.

FIG. 7 shows a block diagram of a system for compensating a frequency response of a microphone according to various embodiments of the present invention. As shown in FIG. 7, the system includes calibration speaker 701, microphone array 702, processor 703, and memory 704. When the system is in a microphone recalibration mode, calibration speaker 701 sends out a compensation signal. Multiple microphones in microphone array 702 receive the compensation signal sent from calibration speaker 701 and output multiple microphone output signals to processor 703 respectively. Processor 703 determines a uniform frequency response of the multiple microphones based on the multiple output signals output by microphone array 702, calculates a compensation gain for each microphone in the microphone array according to the uniform frequency response, and stores the calculated compensation gains in memory 704.

Processor 703 is also configured to determine whether the calibration speaker is positioned to be equally spaced from the microphones in the microphone array. When the processor determines that the calibration speaker is positioned to be equally spaced from the microphones in the microphone array, a frequency response of an output signal of one microphone in the microphone array may be selected as a uniform frequency response UFR, a compensation gain of the selected microphone is set to 1, and a compensation gain of each microphone in the remaining microphones of the microphone array is calculated as a ratio of the uniform frequency response UFR to a frequency response amplitude of an output signal of the microphone.

Further, processor 703 is also configured to calculate, when it is determined that the calibration speaker is positioned to be equally spaced from the microphones in the microphone array, frequency response amplitudes of all or part of the multiple output signals, take a weighted sum of the frequency response amplitudes as the uniform frequency response UFR, and calculate the compensation gain of each microphone in the microphone array as a ratio of the uniform frequency response UFR to a frequency response amplitude of an output signal of the microphone.

Further, processor 703 is also further configured to calculate, when it is determined that the calibration speaker is positioned to be equally spaced from the microphones in the microphone array, frequency response energies of all or part of the multiple output signals, take a weighted sum of the frequency response energies as the uniform frequency response UFR, and set the compensation gain of each of the multiple microphones as a ratio of the uniform frequency response UFR to a frequency response energy of an output signal of the microphone.

Further, the processor 703 is also configured to further determine, when the processor determines that the calibration speaker is not positioned to be equally spaced from the microphones in the microphone array, whether the calibration speaker is located on a central symmetry axis of the microphone array. If the calibration speaker is located on the central symmetry axis of the microphone array and the number of microphones in the microphone array is an even number, the multiple microphones are grouped by grouping every two microphones equally spaced from the calibration speaker. If the calibration speaker is located on the central symmetry axis of the microphone array and the number of microphones in the microphone array is an odd number, multiple microphones other than the microphone located on the central symmetry axis are grouped by grouping every two microphones equally spaced from the calibration speaker.

Further, processor 703 is also further configured to select, when the number of microphones in the microphone array is an even number, a frequency response of an output signal of one microphone in each group of microphones as a uniform frequency response of the group, set a compensation gain of the selected microphone to 1, and calculate a compensation gain of the other microphone in the group of microphones as a ratio of the uniform frequency response of the group to a frequency response amplitude of an output signal of the other microphone in the group of microphones.

Further, processor 703 is also further configured to calculate, when the number of microphones in the microphone array is an even number, frequency response amplitudes of output signals of each group of microphones, take a weighted sum of the frequency response amplitudes of the output signals as a uniform frequency response of the group, and calculate a compensation gain of each microphone in the group of microphones as a ratio of the uniform frequency response of the group to a frequency response amplitude of an output signal of the microphone.

Further, processor 703 is also further configured to calculate, when the processor determines that the number of microphones in the microphone array is an even number, frequency response energies of multiple output signals of each group of microphones, take a weighted sum of the frequency response energies as a uniform frequency response of the group, and calculate a compensation gain of each microphone in the group of microphones as a ratio of the uniform frequency response of the group to a frequency response energy of an output signal of the microphone.

Further, processor 703 is also further configured to select, when the number of microphones in the microphone array is an odd number, a frequency response of an output signal of one microphone in each group of microphones as a uniform frequency response of the group, set a compensation gain of the selected microphone to 1, calculate a compensation gain of the other microphone in the group of microphones as a ratio of the uniform frequency response of the group to a frequency response amplitude of an output signal of the other microphone in the group of microphones, and set a compensation gain of the microphone located on the central symmetry axis to 1.

Further, processor 703 is also further configured to calculate, when the number of microphones in the microphone array is an odd number, frequency response amplitudes of output signals of each group of microphones, take a weighted sum of the frequency response amplitudes of the output signals as a uniform frequency response of the group, calculate a compensation gain of each microphone in the group of microphones as a ratio of the uniform frequency response of the group to a frequency response amplitude of an output signal of the microphone, and set a compensation gain of the microphone located on the central symmetry axis to 1.

Further, processor 703 is also further configured to calculate, when the number of microphones in the microphone array is an odd number, frequency response energies of output signals of each group of microphones, take a weighted sum of the frequency response energies of the output signals as a uniform frequency response of the group, calculate a compensation gain of each microphone in the group of microphones as a ratio of the uniform frequency response of the group to a frequency response energy of an output signal of the microphone, and set a compensation gain of the microphone located on the central symmetry axis to 1.

The processor of the present invention as a whole may be a microprocessor, an application specific integrated circuit (ASIC), a system on chip (SoC), a mobile computing device (e.g., a tablet computer or a mobile phone), a media player, etc.

Any one or more of the processor, memory, or system described herein includes computer-executable instructions that may be compiled or interpreted from computer programs created using various programming languages and/or technologies. Generally speaking, a processor (such as a microprocessor) receives and executes instructions, for example, from a memory, a computer-readable medium, etc. The processor includes a non-transitory computer-readable storage medium capable of executing instructions of a software program. The computer-readable medium can be, but is not limited to, an electronic storage device, a magnetic storage device, an optical storage device, an electromagnetic storage device, a semiconductor storage device, or any suitable combination thereof.

The description of the implementations has been presented for the purposes of illustration and description. Appropriate modifications and changes of the implementations can be implemented in view of the above description or can be obtained through practical methods. For example, unless otherwise indicated, one or more of the methods described may be performed by a combination of suitable devices and/or systems. The method can be performed in the following manner: using one or more logic devices (for example, processors) in combination with one or more additional hardware elements (such as storage devices, memories, circuits, hardware network interfaces, etc.) to perform stored instructions. The method and associated actions can also be executed in parallel and/or simultaneously in various orders other than the order described in this application. The system is illustrative in nature, and may include additional elements and/or omit elements. The subject matter of the present disclosure includes all novel and non-obvious combinations of the disclosed various methods and system configurations and other features, functions, and/or properties.

As used in this application, an element or step listed in the singular form and preceded by the word "one/a" should be understood as not excluding a plurality of said elements or steps, unless such exclusion is indicated. Furthermore, references to "one implementation" or "an example" of the present disclosure are not intended to be interpreted as excluding the existence of additional implementations that also incorporate the recited features. The present invention has been described above with reference to specific embodiments. However, those of ordinary skill in the art will understand that various modifications and changes can be made without departing from the broader spirit and scope of the present invention as set forth in the appended claims.

What is claimed is:

1. A method for compensating a frequency response of a microphone, comprising:

receiving a compensation signal at multiple microphones in a microphone array from a calibration speaker and outputting multiple output signals;

determining a uniform frequency response of the multiple microphones based on the multiple output signals;

calculating a compensation gain for each of the multiple microphones according to the uniform frequency response; and storing the calculated compensation gain of each microphone; and determining whether the calibration speaker is positioned to be equally spaced from the microphones in the microphone array, wherein when the calibration speaker is not positioned to be equally spaced from the microphones in the microphone array, determining whether the calibration speaker is located on a central symmetry axis of the microphone array;

wherein, responsive to the calibration speaker being located on the central symmetry axis of the microphone array and a number of microphones in the microphone array being an even number, the multiple microphones are grouped by grouping every two microphones equally spaced from the calibration speaker;

wherein, responsive to the calibration speaker being located on the central symmetry axis of the microphone array and the number of microphones in the microphone array being an odd number, multiple microphones other than the microphone located on the central symmetry axis are grouped by grouping every two microphones equally spaced from the calibration speaker; and wherein when the number of microphones in the microphone array is an even number, a frequency response of an output signal of one microphone in each group of microphones is selected as a uniform frequency response of the group, a compensation gain of the selected microphone is set to 1, and a compensation gain of the other microphone in the group of microphones is calculated as a ratio of the uniform frequency response of the group to a frequency response amplitude of an output signal of the other microphone in the group of microphones.

2. The method of claim 1, wherein when the calibration speaker is positioned to be equally spaced from the microphones in the microphone array, a frequency response of an output signal of one microphone in the microphone array is selected as the uniform frequency response, a compensation gain of the selected microphone is set to 1, and the compensation gain of each of the remaining microphones in the microphone array is calculated as a ratio of the uniform frequency response to a frequency response amplitude of an output signal of the microphone.

3. The method of claim 1, wherein when the calibration speaker is positioned to be equally spaced from the microphones in the microphone array, frequency response amplitudes of all or part of the multiple output signals are calculated, a weighted sum of the frequency response amplitudes is taken as the uniform frequency response, and the compensation gain of each microphone in the microphone array is calculated as a ratio of the uniform frequency response to a frequency response amplitude of an output signal of the microphone.

4. The method of claim 1, wherein when the calibration speaker is positioned to be equally spaced from the microphones in the microphone array, frequency response energies of all or part of the multiple output signals are calculated, a weighted sum of the frequency response energies is taken as the uniform frequency response, and the compensation gain of each of the multiple microphones is calculated as a ratio of the uniform frequency response to a frequency response energy of an output signal of the microphone.

5. The method of claim 1, wherein when the number of microphones in the microphone array is an even number, frequency response amplitudes of output signals of each group of microphones are calculated, a weighted sum of the frequency response amplitudes of the output signals is taken as a uniform frequency response of the group, and a compensation gain of each microphone in the group of microphones is calculated as a ratio of the uniform frequency response of the group to a frequency response amplitude of an output signal of the microphone.

6. The method of claim 1, wherein when the number of microphones in the microphone array is an even number, frequency response energies of multiple output signals of each group of microphones are calculated, a weighted sum of the frequency response energies is taken as a uniform frequency response of the group, and a compensation gain of each microphone in the group of microphones is calculated as a ratio of the uniform frequency response of the group to a frequency response energy of an output signal of the microphone.

7. The method of claim 1, wherein when the number of microphones in the microphone array is an odd number, a frequency response of an output signal of one microphone in each group of microphones is selected as a uniform frequency response of the group, a compensation gain of the selected microphone is set to 1, a compensation gain of the other microphone in the group of microphones is calculated as a ratio of the uniform frequency response of the group to a frequency response amplitude of an output signal of the other microphone in the group of microphones, and a compensation gain of the microphone located on the central symmetry axis is set to 1.

8. The method of claim 1, wherein when the number of microphones in the microphone array is an odd number, frequency response amplitudes of output signals of each group of microphones are calculated, a weighted sum of the frequency response amplitudes of the output signals is taken as a uniform frequency response of the group, a compensation gain of each microphone in the group of microphones is calculated as a ratio of the uniform frequency response of the group to a frequency response amplitude of an output signal of the microphone, and a compensation gain of the microphone located on the central symmetry axis is set to 1.

9. The method of claim 1, wherein when the number of microphones in the microphone array is an even number, frequency response energies of output signals of each group of microphones are calculated, a weighted sum of the frequency response energies of the output signals is taken as a uniform frequency response of the group, a compensation gain of each microphone in the group of microphones is calculated as a ratio of the uniform frequency response of the group to a frequency response energy of an output signal of the microphone, and a compensation gain of the microphone located on the central symmetry axis is set to 1.

10. A system for compensating a frequency response of a microphone, comprising:

a calibration speaker configured to transmit a compensation signal;

a microphone array comprising multiple microphones to receive the compensation signal and to transmit multiple output signals;

a processor configured to:

determine a uniform frequency response of the multiple microphones based on the multiple output signals;

calculate a compensation gain for each of the multiple microphones according to the uniform frequency response;

determine whether the calibration speaker is positioned to be equally spaced from the microphones in the microphone array, determine whether the calibration speaker is located on a central symmetry axis of the microphone array responsive to the calibration speaker not being positioned to be equally spaced from the microphones in the microphone array;

group the multiple microphones such that every two microphones are equally spaced from the calibration speaker responsive to the calibration speaker being located on the central symmetry axis of the microphone array and a number of microphones in the microphone array being an even number;

group multiple microphones other than the microphone located on the central symmetry axis such that every two microphones are equally spaced from the calibration speaker responsive to the calibration speaker being located on the central symmetry axis of the microphone array and the number of microphones in the microphone array being an odd number; and select a frequency response of an output signal of one microphone in each group of microphones as a uniform frequency response of the group, set a compensation gain of the selected microphone to 1, and calculate a compensation gain of the other microphone in the group of microphones as a ratio of the uniform frequency response of the group to a frequency response amplitude of an output signal of the other microphone in the group of microphones responsive to the number of microphones in the microphone array being an even number; and a memory configured to store the calculated compensation gain of each microphone.

11. A computer-program product embodied in a non-transitory computer readable medium that is stored in memory and that is executable by a processor for compensating a frequency response of a microphone, the computer-program product comprising instructions for:

receiving a compensation signal at multiple microphones in a microphone array from a calibration speaker and outputting multiple output signals;

determining a uniform frequency response of the multiple microphones based on the multiple output signals;

calculating a compensation gain for each of the multiple microphones according to the uniform frequency response;

storing the calculated compensation gain of each microphone; and determining whether the calibration speaker is positioned to be equally spaced from the microphones in the microphone array, wherein when the calibration speaker is not positioned to be equally spaced from the microphones in the microphone array, determining whether the calibration speaker is located on a central symmetry axis of the microphone array;

wherein, responsive to the calibration speaker being located on the central symmetry axis of the microphone array and a number of microphones in the microphone array being an even number, the multiple microphones are grouped by grouping every two microphones equally spaced from the calibration speaker;

wherein, responsive to the calibration speaker being located on the central symmetry axis of the microphone array and the number of microphones in the microphone array being an odd number, multiple microphones other than the microphone located on the central symmetry axis are grouped by grouping every two microphones equally spaced from the calibration speaker; and wherein when the number of microphones in the microphone array is an even number, a frequency response of an output signal of one microphone in each group of microphones is selected as a uniform frequency response of the group, a compensation gain of the selected microphone is set to 1, and a compensation gain of the other microphone in the group of microphones is calculated as a ratio of the uniform frequency response of the group to a frequency response amplitude of an output signal of the other microphone in the group of microphones.

12. The computer-program product of claim 11, wherein when the calibration speaker is positioned to be equally spaced from the microphones in the microphone array, a frequency response of an output signal of one microphone in the microphone array is selected as the uniform frequency response, a compensation gain of the selected microphone is set to 1, and the compensation gain of each of the remaining microphones in the microphone array is calculated as a ratio of the uniform frequency response to a frequency response amplitude of an output signal of the microphone.

13. The computer-program product of claim 11, wherein when the calibration speaker is positioned to be equally spaced from the microphones in the microphone array, frequency response amplitudes of all or part of the multiple output signals are calculated, a weighted sum of the frequency response amplitudes is taken as the uniform frequency response, and the compensation gain of each microphone in the microphone array is calculated as a ratio of the uniform frequency response to a frequency response amplitude of an output signal of the microphone.

14. The computer-program product of claim 11, wherein when the calibration speaker is positioned to be equally spaced from the microphones in the microphone array, frequency response energies of all or part of the multiple output signals are calculated, a weighted sum of the frequency response energies is taken as the uniform frequency response, and the compensation gain of each of the multiple microphones is calculated as a ratio of the uniform frequency response to a frequency response energy of an output signal of the microphone.

* * * * *